United States Patent [19]

Mori

[11] 3,948,134

[45] Apr. 6, 1976

[54] MACHINE TOOL DRIVING APPARATUS

[76] Inventor: Masunori Mori, 21-5, Nozaki, Wakayama, Wakayama, Japan

[22] Filed: Dec. 18, 1974

[21] Appl. No.: 533,762

[30] Foreign Application Priority Data

Jan. 29, 1974 Japan ..... 49-11404

[52] U.S. Cl. ..... 83/625; 74/105; 83/643; 83/698

[51] Int. Cl.[2] ..... B26D 5/08

[58] Field of Search ..... 83/624, 625, 626, 633, 83/632, 642, 643, 698, 699; 74/512, 110, 105

[56] References Cited

UNITED STATES PATENTS 1,439,556 12/1922 Kirsch ..... 83/625

3,866,503 2/1975 Gal ..... 83/626

*Primary Examiner*—Donald R. Schran

*Assistant Examiner*—W. D. Bray

[57] ABSTRACT

A machine tool driving device suitable for use in a shearing machine, a press or the like which has a machine tool mounted on a tool support vertically movable along a fixed frame, the device comprising at least a pair of links connected to the support for drivingly imparting vertical reciprocating movements thereto, the pair of links being always disposed symmetrically with respect to an imaginary vertical plane which passes through the center of the tool support plate so that horizontal components of the driving force which is imposed on the support by the paired links are cancelled by each other to allow high precision work.

5 Claims, 4 Drawing Figures

MACHINE TOOL DRIVING APPARATUS

BACKGROUND OF THE INVENTION

This invention relates to a machine tool driving device suitable for use in a shearing machine, a press and other metal plate machining apparatus.

In a machine tool driving device, a synchronization mechanism plays an important role as is well known in the art, the mechanism being based on either electric or mechanical controls. This invention is specifically directed to a machine tool driving device having a mechanical synchronization mechanism.

There have been proposed various devices of this nature, for example, U.S. Pat. No. 3,157,084 where, as shown in FIG. 1, a blade 1 is integrally mounted on a tool support 2. The tool support 2 is connected by links 8 and 9 to rocking arms 4 and 5 which are pivotally supported by pins 6 and 7, respectively. The rocking arms 4 and 5 are adapted to transmit a reciprocating motion of a piston-cylinder 3 to the links 8 and 9 which, in turn, drivingly impart vertical reciprocating motion to the tool support plate 2 and the blade 1.

In the prior-art apparatus with the construction just described, however, a difficulty is often encountered in that, as the links 8 and 9 are disposed parallel to each other, the support 2 is imposed with not only a vertical force but also some horizontal force during the machining operation. This phenomenon is now discussed in greater detail with reference to FIG. 2. As is shown, the forces F and P which are applied to the support by the links 8 and 9, respectively, have vertical components $F_1$ and $P_1$ and horizontal components $F_2$ and $P_2$. The components $F_2$ and $P_2$, therefore, represent the horizontal force which is imposed on the support 2 during the machining operation, which can be a major drawback of this prior-art apparatus.

SUMMARY OF THE INVENTION

It is an object of the invention to provide a machine tool driving device suitable for use in a machine tool for machining a metal plate, which device overcome the afore-described shortcoming of the prior-art apparatus.

According to the present invention, there is provided a device which has at least one pair of non-parallel links, disposed symmetrically to cancell out and substantially eliminate the horizontal force which may be otherwise imposed on a machine tool support by the individual links. The device of the invention thus enables a well synchronized high precision machining operation.

The above and other objects, features and advantages of the invention will become clear from the following particular description of the invention and the appended claims, taken in conjunction with the accompanying drawings which show by way of example a preferred embodiment of the present invention in comparison with the prior-art apparatus.

Figure 3:
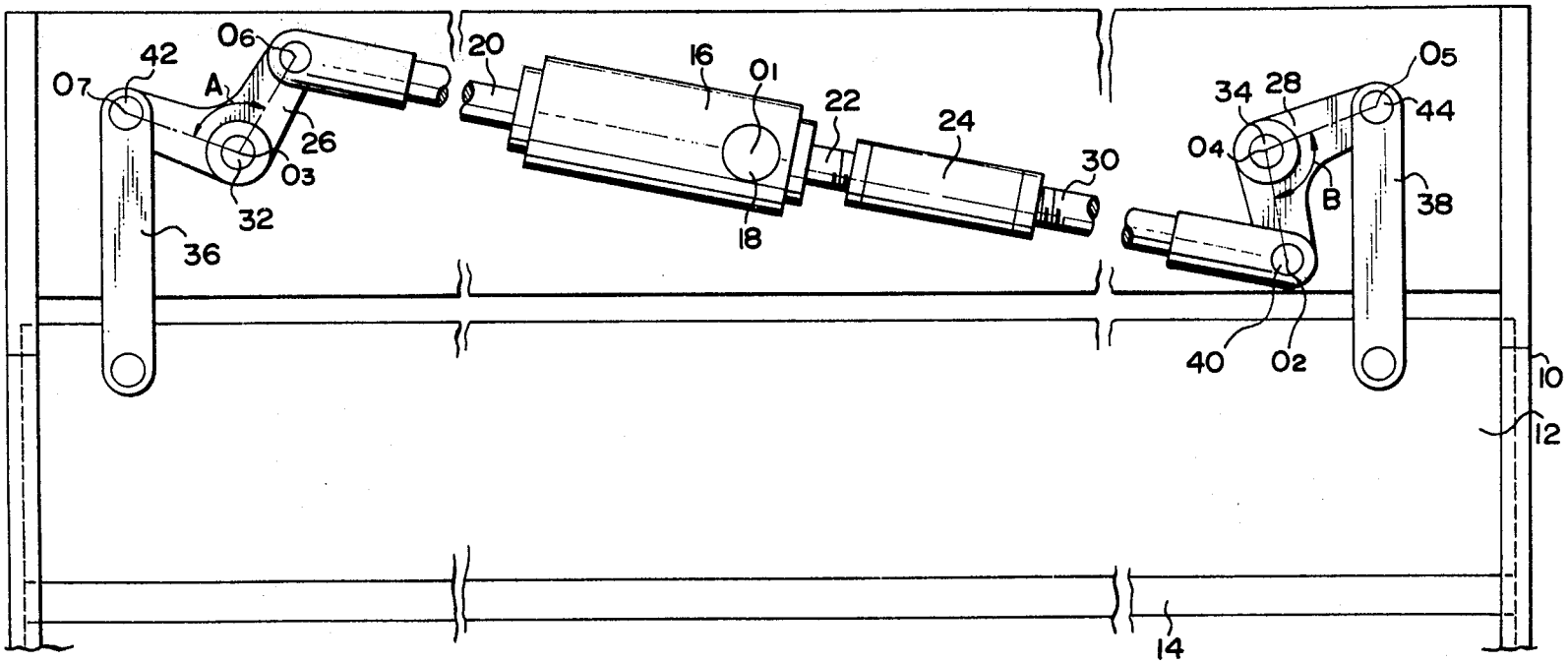
FIG. 3 is a schematic view showing in front elevation a machine tool driving device of the invention as connected to a tool support of a shearing machine.

PARTICULAR DESCRIPTION OF THE INVENTION:

Referring to FIG. 3, a machining apparatus which may be suitable for use with the device of the invention has a frame 10, a tool support plate 12 and a machine tool 14 in the form of a blade, stamping die or the like. The tool support plate 12 is vertically movable up and down along the frame 10 to effect a desired machining operation in the well known manner. As the construction of the tool support plate and the frame are same as those employed in the conventional apparatus, a detailed description in this regard will be omitted. It should be understood that the device of the invention can be suitably applied to a machining apparatus of a type different from the one just described.

A piston-cylinder apparatus 16, which is driven by pressurized oil and constitutes a driving source, is pivotally mounted by a pin 18 for free rotation with respect to the frame 10. The piston-cylinder apparatus 16 has at one end thereof a first piston rod 20 which is rotatably linked to a first rocking member 26 at $O_6$. The piston-cylinder apparatus 16 has at the other end thereof a second piston rod 22 which is interlinked through an adjusting mechanism 24, for example of a differential screw, to one end of a connecting member 30. The other end of the connecting member 30 is pivotally connected to a second rocking member 28 at $O_2$. The first and the second rocking members 26 and 28 are pivotally connected to the frame 10 by pins 32 and 34, respectively. The rocking members 26 and 28 are pivotally joined to links 36 and 38 at $O_7$ and $O_5$, respectively, which in turn are pivotally connected to the tool support plate 12.

The pins 32 and 34 are so arranged that their rotational axes $O_3$ and $O_4$ are respectively located in positions equidistant from the rotational axis $O_1$ of the pin 18. Furthermore, the pins 32, 18 and 34 should be so positioned that the axes $O_3$, $O_1$ and $O_4$ are aligned on one line. Also the angle $<O_6, O_3, O_7$ or angle A is made equal to the angle $<O_2, O_4, O_5$ or angle B as shown in FIG. 3.

The operation of the device of the invention with the construction just described is now discussed with reference to FIGS. 3 and 4.

During the piston stroke in which the rods 20 and 22 are moved to the right as seen in FIG. 3, the rocking members 26 and 28 are turned clockwise and counterclockwise, respectively, to cooperatively raise the tool support plate 12 through the links 36 and 38. Throughout this stroke, the links 36 and 38 are disposed symmetrically. During the next stroke in which the rods 20 and 22 are moved to the left, the rocking members 26 and 28 are now turned in the opposite directions to lower the tool support plate 12 through the links 36 and 38 which still maintain symmetric positional relationship. By repetition of this cycle, the support 12 is reciprocatingly moved in the vertical direction to carry out a predetermined operation by the machine tool 14.

The adjusting mechanism 24 is provided to facilitate adjustment of the distance between the rotational axis $0_1$ of the pin 18 and the rotational axis $0_2$ of a pin 40 which pivotally connects the connecting member 30 with the second rocking member 28. By increasing the distance, it is possible to raise the right-hand side of the tool support plate 12, as seen in FIG. 3, while maintaining the initial height at the left-hand side. Likewise, shortening of the distance results in lowering of the right-hand side with respect to the rest, thus facilitating a proper alignment of the tool support 12 and the machine tool 14.

Figure 1:
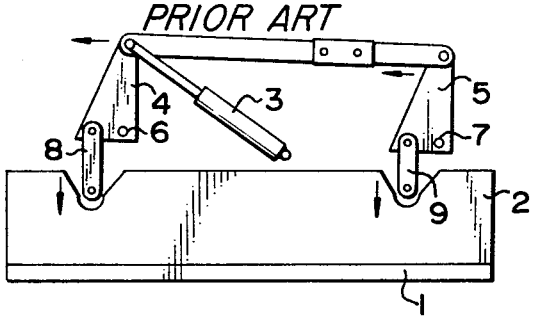
FIG. 1 PRIOR ART
FIG. 1 is a schematic view showing in front elevation a prior-art machining apparatus.
Figure 2:
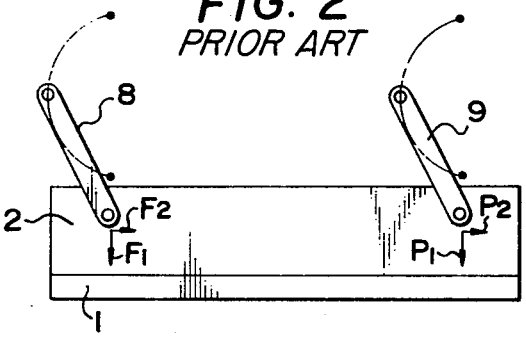
FIG. 2 PRIOR ART
FIG. 2 is a schematic view showing on an enlarged scale the operation of links in the prior-art apparatus of FIG. 1.
Figure 4:
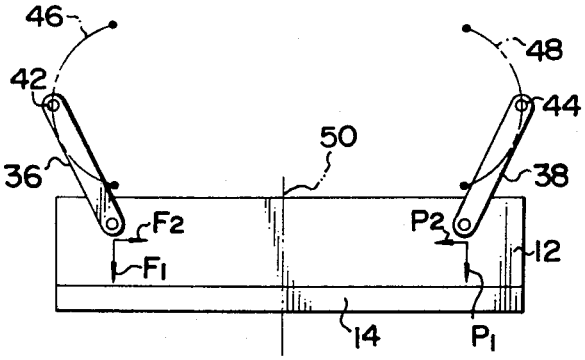
FIG. 4 is a schematic view showing on an enlarged scale the operation of links in the device of FIG. 4.

Referring to FIG. 4, the pin 42 which joins the link 36 to the first rocking member 26 moves, during the machining operation, along a path 46 which is shown in the figure by a broken line. Likewise, the pin 44 which joins the link 38 to the second rocking member 38 takes a path 48 which is also shown by a broken line. In this manner, the links 36 and 38 always assume symmetric positions with respect to a center line 50 and a resultant force in the horizontal direction, which may be designated as $F_2 - P_2$, becomes always nil.

The foregoing description illustrated by way of example only one preferred embodiment of the invention. It would be clear, however, that the application of the invention is by no way restricted to the particular embodiment, and that many changes and modifications may be made without departing from the spirit of the invention.

What is claimed is:

1. A machine tool driving device for a metal plate machining apparatus having a machine tool mounted on a tool support plate which is movable in a vertical direction toward and away from a metallic workpiece, said driving device comprising at least one pair of elongated links pivotally connected at a first end thereof to the tool support plate, a pair of rigid bell cranks each one of which is pivotable about an axis intermediate the ends of the two arms thereof, one arm of each said bell crank being pivotally connected to the second end of one of said links, an elongated driving source pivotally mounted intermediate the ends thereof and coupled pivotably at the ends thereof to the second arm of each said bell crank, the pivot axes of said pair of bell cranks and said driving source being in a common plane, said links being disposed symmetrically with respect to an imaginary plane passing through the center of said tool support plate whereby horizontal components of the driving force which is imposed on the support plate by said pair of links are cancelled by each other.

2. A device as defined in claim 1, wherein said driving source is a piston-cylinder apparatus driven by pressurized oil.

3. A device as defined in claim 1, wherein adjusting means are included for varying the length of said driving source.

4. A device as defined in claim 1 wherein the pivot axes of said bell cranks are equidistant from the pivot axis of said driving source.

5. A device as defined in claim 1 wherein the angle between the arms of said bell cranks is the same as the angle between the arms of said other bell crank.

* * * * *

UNITED STATES PATENT OFFICE

CERTIFICATE OF CORRECTION

PATENT NO. : 3948134
DATED : April 6, 1976
INVENTOR(S) : MASUNORI MORI

It is certified that error appears in the above-identified patent and that said Letters Patent are hereby corrected as shown below:

Column 4, line 28, insert --one of-- before "said bell cranks"

Signed and Sealed this

*fifteenth* Day of *June 1976*

[SEAL]

*Attest:*

RUTH C. MASON
*Attesting Officer*

C. MARSHALL DANN
*Commissioner of Patents and Trademarks*